United States Patent [19]

Buhler et al.

[11] Patent Number: 4,875,626

[45] **Date of Patent: * Oct. 24, 1989**

[54] PISTON-POWERED DISPENSING SYSTEM

[75] Inventors: James E. Buhler, Waterford; James R. Crapser, Caledonia; Allen D. Miller, Mount Pleasant; Mark E. Wefler, Caledonia, all of Wis.

[73] Assignee: S. C. Johnson & Son, Inc., Racine, Wis.

[ * ] Notice: The portion of the term of this patent subsequent to Aug. 30, 2005 has been disclaimed.

[21] Appl. No.: 238,026

[22] Filed: Aug. 29, 1988

Related U.S. Application Data

[63] Continuation-in-part of Ser. No. 153,737, Feb. 8, 1988, Pat. No. 4,767,059.

[51] Int. Cl.[4] ..... B05B 7/24

[52] U.S. Cl. ..... 239/314; 137/99; 222/134; 222/144.5; 239/315; 239/322; 239/414; 239/416; 239/416.4

[58] Field of Search ..... 239/310, 313, 314, 315, 239/322, 331, 414, 416, 416.4–417.3, 424.5; 222/134, 144.5; 137/99

[56] References Cited

U.S. PATENT DOCUMENTS

| | | | |
|---|---|---|---|
| 368,259 | 8/1987 | Warren . | |
| 716,910 | 12/1902 | Lubbecke . | |
| 1,030,119 | 6/1912 | Overbeke | 239/322 |
| 1,117,228 | 11/1914 | Overbeke . | |
| 1,179,905 | 4/1916 | Englemann . | |
| 1,241,551 | 10/1917 | Preston et al. . | |
| 1,347,520 | 7/1920 | Rasch . | |
| 1,370,687 | 3/1921 | Ferris . | |
| 1,382,684 | 6/1921 | Shimper | 239/424.5 |
| 1,578,944 | 3/1926 | Wilkinson | 239/322 |
| 1,579,869 | 4/1926 | Klages | 239/315 |
| 1,590,430 | 6/1926 | Erby | 239/322 |
| 1,948,533 | 2/1934 | Neely . | |
| 2,096,554 | 10/1937 | Maehr . | |
| 2,228,705 | 1/1941 | Olson . | |
| 2,620,234 | 12/1952 | Schaich | 239/322 |
| 2,708,600 | 5/1955 | Froidevaux | 239/322 |
| 2,891,732 | 6/1959 | Orter et al. | 239/322 |
| 3,182,860 | 5/1965 | Gallo . | |
| 3,192,950 | 9/1965 | Weese et al. . | |
| 3,217,936 | 7/1965 | Abplanalp . | |
| 3,225,759 | 11/1965 | Drapen et al. . | |
| 3,261,426 | 7/1966 | Kuhlman . | |
| 3,391,829 | 7/1968 | Gregory | 239/313 |
| 4,047,541 | 9/1977 | Mercier et al. | 239/322 |
| 4,134,523 | 1/1979 | Hansen et al. . | |
| 4,174,068 | 11/1979 | Rudolph | 239/322 |
| 4,406,406 | 9/1983 | Knapp | 239/322 |
| 4,418,869 | 12/1983 | Healy . | |
| 4,545,535 | 10/1985 | Knapp . | |
| 4,583,688 | 4/1986 | Crapser | 239/314 |
| 4,653,691 | 3/1987 | Grime | 239/416 |
| 4,682,734 | 7/1987 | Proctor et al. | 239/315 |
| 4,767,059 | 8/1988 | Crapser et al. | 239/314 |

*Primary Examiner*—Andres Kashnikow
*Assistant Examiner*—Michael J. Forman

[57] ABSTRACT

A piston-powered fluid dispensing system is disclosed. The fluid dispensing system comprises an apertured base, a hollow elongated cylinder, an apertured piston, a hollow orificed overcap, an elongated fluid passageway, an externally-channeled hollow extension, and three valves. The elongated cylinder, which defines a longitudinal axis, carries the base at one end portion and defines a hollow neck at the opposite end portion. The piston, disposed in the cylinder for providing two cylinder chambers, defines a circumferential portion that is slidably engageable with the cylinder substantially along the length of an inner surface. The overcap, carried by the cylinder and rotatable about the longitiudinal axis, defines an internal fluid-mixing region and a throat that is in fluid communication with the fluid-mixing region. The throat, carrying the externally-channeled extension, is slidably engageable with an inner surface portion of the cylinder neck. The extension, also slidably engageable with the inner surface portion of the cylinder neck, carries the fluid passageway and provides fluid communication between the fluid passageway and the fluid-mixing region. At least one external channel of the hollow extension is able to provide fluid communication between one cylinder chamber and the fluid-mixing region. One valve is carried by the base. A second valve, carried by the fluid passageway, abuttingly engages the first valve. A third valve, provided by relative movement between the extension and neck, controllably affects flow between the one of the two cylinder chambers and the fluid-mixing region.

4 Claims, 5 Drawing Sheets

PISTON-POWERED DISPENSING SYSTEM

REFERENCE TO RELATED APPLICATION

This patent application is a continuation-in-part application of Pat. Application Ser. No. 153,737 (now U.S. Pat. No. 4,767,059 issued Aug. 30, 1988), filed Feb. 8, 1988, the benefit of which is now claimed for purposes of priority pursuant to 35 USC § 120.

TECHNICAL FIELD OF THE INVENTION

The present invention is generally directed to a piston-powered fluid dispensing system. The piston-powered fluid dispensing system of the present invention, more particularly, is specifically configured to internally mix certain internally-contained fluid ingredients that are to be dispensed.

BACKGROUND OF THE INVENTION

Compartmented spray devices, wherein certain spraying compartments are separated by a movable piston, are generally well known. (See, e.g., U.S. Pat. No. 1,030,119 to Overbeke.) Unfortunately, many of the sprayer devices of this sort often present certain problems in operation and, as a result, greater sophistication or complexity in design is often deemed warranted. Greater complexity in design, however, typically gives rise to greater complexity in operation. (See, in particular, U.S. Pat. No. 1,117,228, also to Overbeke; and see U.S. Pat. No. 1,241,551 to Preston et al.; U.S. Pat. No. 1,347,520 to Rasch; U.S. Pat. No. 3,217,936 to Abplanalp; U.S. Pat. No. 3,225,759 to Drapen et al.; and U.S. Pat. Nos. 4,406,406 and 4,545,535, both to Knapp.)

Also well known are prior-art fluid dispensing systems that are specifically designed to externally mix ingredients (which are to be dispensed). Many dispensing systems of this type, again unfortunately, are rather complex in design and/or operation, with the result being that the overall effectiveness or utility of each such dispensing system is generally uniquely encumbered by the complexity of its own design. (See, e.g., U.S. Pat. No. 1,347,520 to Rasch; U.S. Pat. No. 1,370,687 to Ferris; U.S. Pat. No. 1,590,430 to Erby; and U.S. Pat. No. 1,948,533 to Neely.) In particular, U.S. Pat. No. 1,948,533 to Neely discloses one such spraying device that is complex not only in design but also in operation as well.

While some prior-art piston-powered dispensing systems—such as that system disclosed in U.S. Pat. No. 2,708,600 to Froidevaux, which features external-mixing of ingredients—tout what seems to be a "simplicity-of-design" feature, many practical applications that utilize such a fluid dispensing system require inclusion of certain structural details (absent from the dispensing system disclosed by Froidevaux) which, if present, would render complex the overall dispensing system, in design and/or in operation.

In light of the sophisticated and demanding nature of many of today's consumers, simplicity-of-design, effectiveness of operation, and overall convenience to the user, are highly desirable features or aspects of any fluid-dispensing system.

While U.S. Pat. No. 4,767,059, mentioned above, discloses a fluid dispensing system which meets these criteria for the external mixing of fluid ingredients that are to be dispensed as a mixture by such a fluid dispensing system, there are times when it is desirable to mix the fluid ingredients internally. For example, one of the fluid ingredients may be so viscous that a desirable degree of fluid mixing can be achieved only by mixing or combining the fluid ingredients within the dispensing system, whereupon the thus-combined ingredients are dispensed, as a mixture, from the fluid dispensing system.

Fluid dispensing systems that are specifically designed to internally mix ingredients are similarly generally well known. (See, e.g., U.S. Pat. No. 368,259 to Warren; U.S. Pat. No. 716,910 to Lubbecke; U.S. Pat. Nos. 1,030,119 and 1,117,228, both to overbeke; U.S. Pat. No. 2,096,554 to Maehr; U.S. Pat. No. 2,620,234 to Schaich; U.S. Pat. No. 3,182,860 to Gallo; U.S. Pat. No. 3,192,950 to Weese et al.; U.S. Pat. No. 3,217,936 to Abplanalp; U.S. Pat. No. 3,225,759 to Drapen et al.; U.S. Pat. No. 3,261,426 to Kuhlman; U.S. Pat. No. 4,174,068 to Rudolph; and U.S. Pat. Nos. 4,406,406 and 4,545,535, both to Knapp.)

Unfortunately, the presently commercially-available fluid dispensing systems that are specifically designed to internally mix ingredients (which are to be dispensed) are generally rather complex in design and/or operation.

The present invention provides today's consumers with a piston-powered fluid dispensing system, that is specifically designed to internally mix fluid ingredients which are to be dispensed, wherein such fluid dispensing system possesses the simplicity-of-design, effectiveness-of-operation, and overall-convenience-to-the-user features, as well as other features and advantages, deemed to be desirable by today's sophisticated consumers.

SUMMARY OF THE INVENTION

The present invention is a novel piston-powered fluid dispensing system which although extremely simple in design and operation nevertheless possesses certain aspects or features which enable a user to control, in a very simple manner, the flow of the fluid ingredients that are to be internally mixed or combined, the thus-mixed fluid ingredients thereafter being dispensed from the system, preferably in the form of a spray or mist, external to the dispenser.

Accordingly, the elements or components of the piston-powered fluid-dispensing system of the present invention comprise; (1) an apertured base defining a coupling; (2) a hollow, elongated cylinder; (3) an apertured piston; (4) a hollow orificed overcap; (5) an elongated fluid passageway; (6)an externally-channeled, hollow extension; and (7–9) three valves.

The hollow elongated cylinder, which defines a longitudinal axis, carries the base at one end portion thereof and further defines a hollow neck at the opposite end portion thereof.

The apertured piston, disposed in the cylinder for dividing the cylinder into at least two chambers, defines a circumferential portion that is slidably engageable with the hollow cylinder substantially along the length of an inner surface thereof.

The hollow orificed overcap, carried by the cylinder and rotatable about the longitudinal axis relative to the cylinder, defines an internal, fluid-mixing region and a throat that is in fluid communication with the fluid-mixing region. The throat, in turn, is slidably engageable with an inner surface portion of the cylinder neck.

The elongated fluid passageway is disposed in the cylinder, and is further disposed through the piston aperture in a fluid-tight manner.

The externally-channeled hollow extension, slidably engageable with the inner surface portion of the cylinder neck and carried by the overcap throat, carries the fluid passageway and provides fluid communication between the fluid passageway and the fluid-mixing region. At least one external channel of the hollow extension is able to provide fluid communication between one of the two cylinder chambers and the fluid-mixing region.

Rotation of either the cylinder or overcap relative to the other about the longitudinal axis causes relative movement as between the externally-channeled hollow extension and the cylinder neck along the longitudinal axis.

One of the three valves is carried by the base.

A second one of the three valves is carried by the fluid passageway and abuttingly engages the first valve.

The third valve, provided by movement of the external channels of the hollow extension relative to the inner surface of the cylinder neck along the longitudinal axis, controllably affects flow between the one of the two cylinder chambers and the fluid-mixing region. Relative movement as between the hollow extension and the cylinder neck along the longitudinal axis, in turn, causes the other two of the three valves to co-act in such a manner as to controllably affect flow of a pressurized fluid from a pressurized-fluid source to the fluid passageway and to an other of the two cylinder chambers, the fluid passageway thereby providing fluid communication of the pressurized fluid between the pressurized-fluid source and the fluid-mixing region.

Other aspects, features and advantages of the present invention are discussed in greater detail hereinbelow.

BRIEF DESCRIPTION OF THE DRAWINGS

Throughout the drawings, like reference numerals refer to like parts.

DETAILED DESCRIPTION OF THE PREFERRED EMBODIMENT

While the present invention will now be described in connection with an illustrated preferred embodiment, it is to be understood that the present invention is not to be limited thereto. On the contrary, as those skilled in the art can particularly appreciate, the present invention is to be understood to cover all structural or functional alternatives or equivalents as are defined by the appended claims.

Best Mode

The following description of the illustrated embodiment presents the best mode, contemplated by the inventors, for particularly pointing out the various principles as well as other aspects, features, advantages, applications and end-uses of the piston-powered fluid-dispensing system of the present invention.

Figure 1:
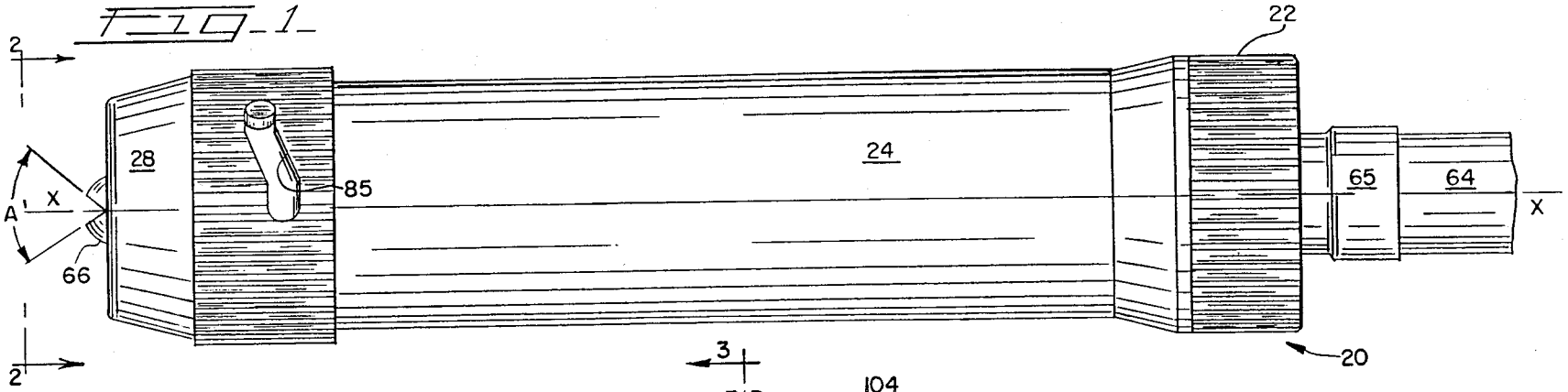
FIG. 1 is a side view, showing the dispensing system in its "operative"mode.
Figure 5:
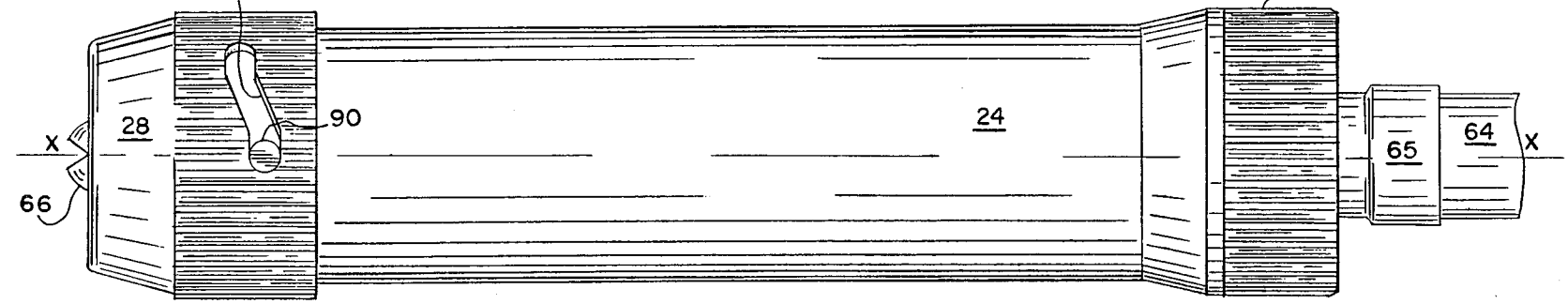
FIG. 5 is a side view, much like the side view of FIG. 1 but showing the dispensing system in its "inoperative" mode.

Referring initially now to FIGS. 1 and 5, there is shown one preferred embodiment of the piston-powered fluid-dispensing system 20 of the present invention. The fluid-dispensing system 20 is preferably suitably dimensioned so as to comfortably and conveniently fit into the hands of an adult human user. This allows an adult human to readily utilize and operate the same. Of course, a larger of smaller dimensioned fluid-dispensing system could readily be designed and manufactured, if desirable.

Figure 3:
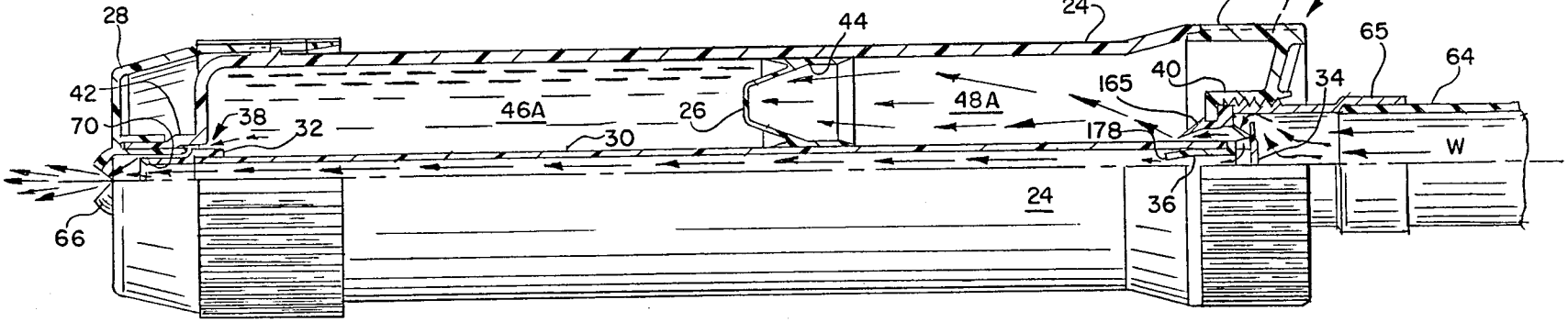
FIG. 3 is the side view of FIG. 1 partially longitudinally in section (and taken from the planes 3—3 of FIG. 2), showing the relative position of certain dispensing system internal elements or components.
Figure 6:
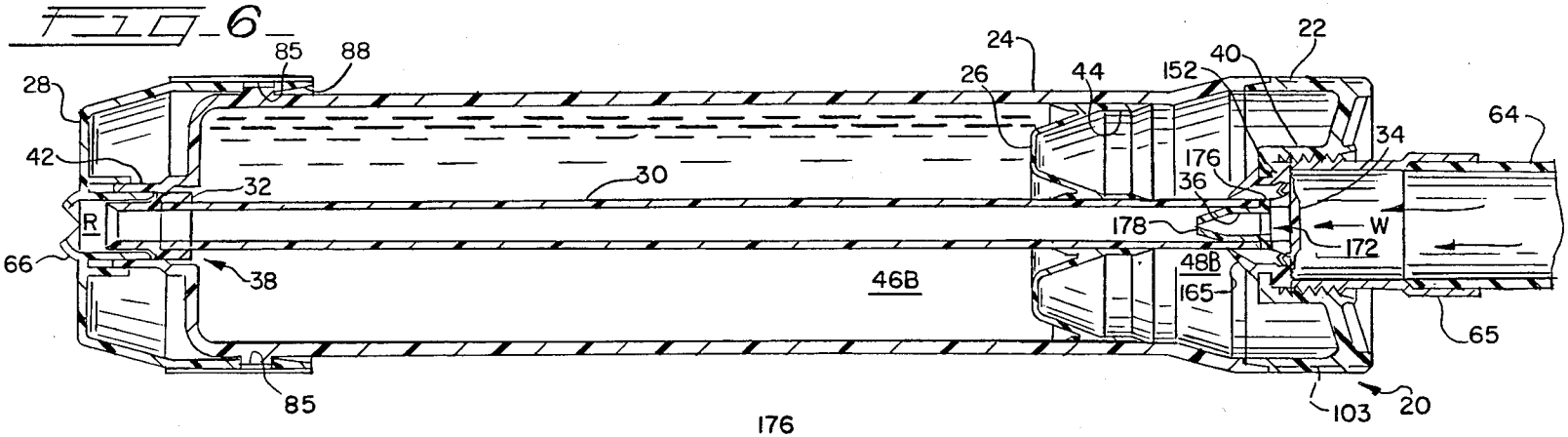
FIG. 6 is the side view of FIG. 5, in section, showing the relative positions of certain dispensing system internal elements or components.

Directing attention to certain elements or components of the fluid-dispensing system 20, while now referring to FIGS. 3 and 6, it can be seen that the fluid-dispensing system 20 comprises an apertured base 22, a hollow elongated cylinder 24, an apertured piston 26, a hollow orificed overcap 28, an elongated fluid passageway 30, an externally-channeled hollow extension 32, and three valves 34, 36 and 38.

The base 22 defines an internally-threaded coupling 40 surrounding the aperture of the base 22. The hollow elongated cylinder 24, which defines a longitudinal axis X—X (FIGS. 1 and 5), carries the apertured base 22 at one end portion thereof and defines a hollow neck 42 (FIGS. 3 and 6) at the opposite end portion thereof.

The apertured piston 26 defines a circumferential portion 44 that is slidably engageable with the hollow cylinder 24 substantially along the length of the inner surface thereof. The apertured piston 26, disposed in the cylinder 24, divides the inner volume of the hollow cylinder 24 into two chambers. As shown in FIG. 3, the first chamber 46A is to the left of the piston 26 and the second chamber 48A is to the right of the piston 26.

The hollow orificed overcap 28, circumferentially carried by the cylinder 24 and rotatable about the longitudinal axis X—X relative thereto, defines an internal fluid-mixing region R (FIG. 7) and a hollow throat 62 (FIGS. 4 and 7) that is in fluid communication with the fluid-mixing region R. The overcap throat 62, removably disposable in the cylinder neck 42 (FIG. 4), defines an exterior surface portion that is slidably engageable with an inner surface portion of the neck 42 (FIGS. 4 and 7).

Figure 7:
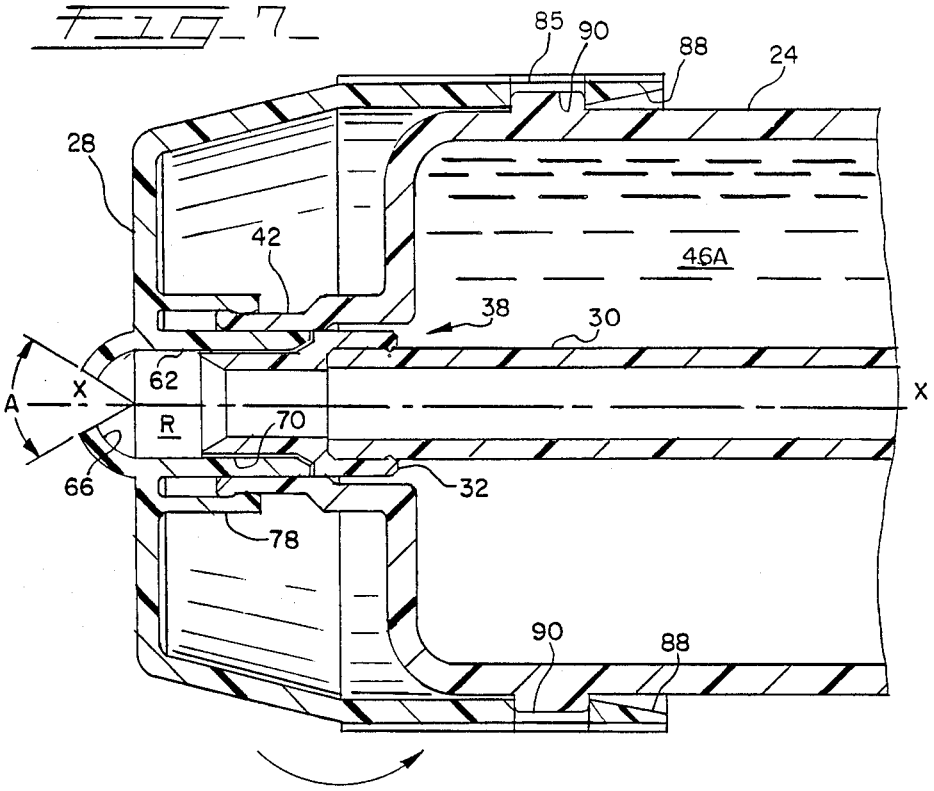
FIG. 7 is a partially fragmented side view, in section, on an enlarged scale relative to FIG. 6.
Figure 4:
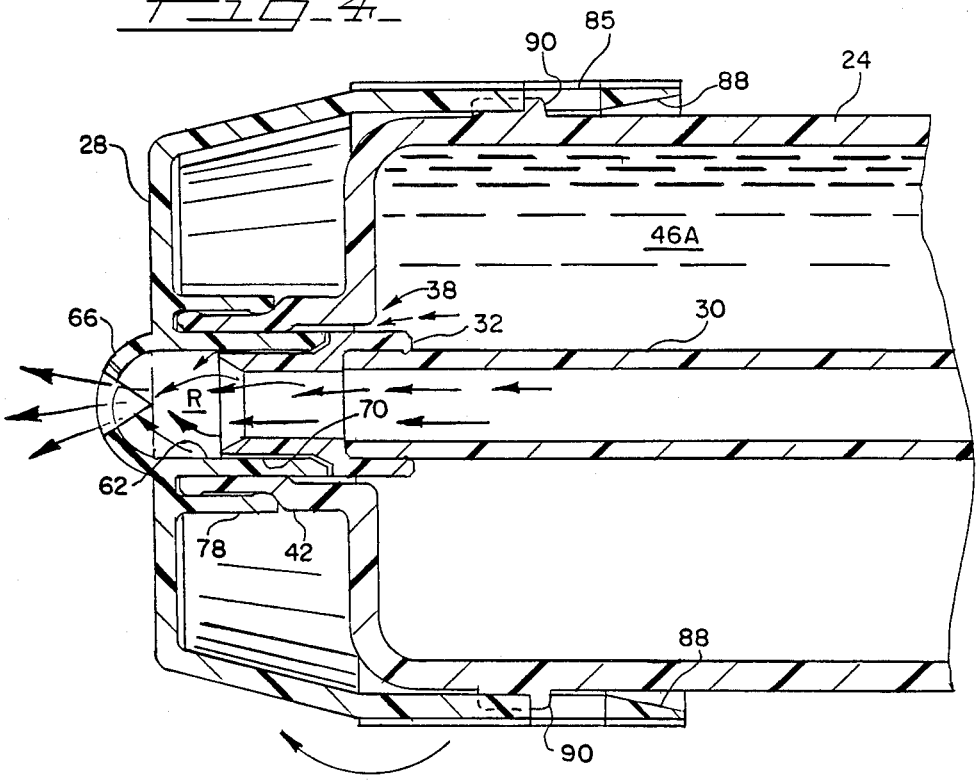
FIG. 4 is a partially fragmented side view, in section, on an enlarged scale relative to FIG. 3.

As is further shown in FIGS. 4 and 7, the illustrated overcap 28 includes a unitary collar 78, which surrounds the overcap throat 62 and is concentric therewith, and which is so spaced from the throat 62 such that the cylinder neck 42 can be snugly removably disposed therebetween.

The elongated fluid passageway 30 is removably disposed in the cylinder 24, and through the aperture of the piston 26 in a substantially fluid-tight manner, and is in fluid communication with the overcap throat 62 via the hollow extension 32. The internal transverse cross-sectional area of the fluid passageway 30 is less than the effective (i.e., annular) transverse cross-sectional area of the piston 26.

A pressurized-fluid source (not shown) is in fluid communication with the coupling 40 of the base 22 via a conduit 64. Conduit 64 preferably includes a threaded end 65 having external circumferential threads that mate with the inner circumferential threads of coupling 40.

Figure 2:
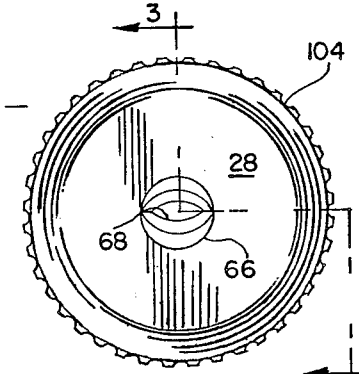
FIG. 2 is an end view, taken along the line 2—2 of FIG. 1.

An orificed hemispherical nozzle 66, further defined by the overcap 28, provides the overcap 28 with an elliptical-shaped orifice 68 (FIG. 2). The size and shape of the orifice 68 can, of course, be different from what is shown, if desired. The illustrated orifice 68 (FIG. 2) defined in part by the angle A (FIG. 7), is further defined by the wall thickness of the illustrated hemispherical nozzle 66. The illustrated angle A, in particular, is preferably about 45 degrees.

Figure 15:
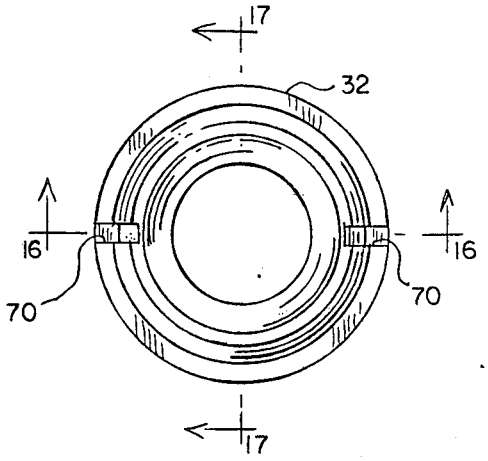
FIG. 15 is an end view taken from the plane 15—15 in FIG. 14.
Figure 16:
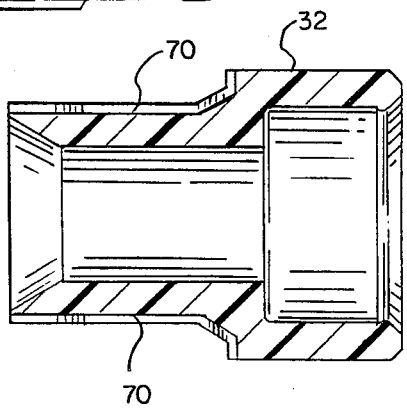
FIG. 16 is a cross sectional view taken along the plane 16—16 in FIG. 15.
Figure 17:
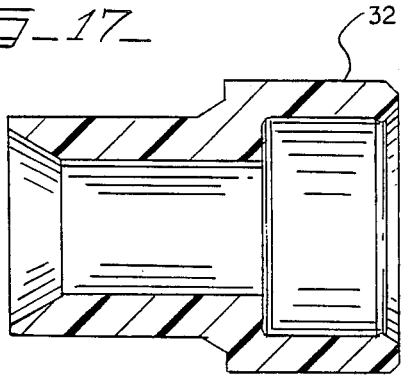
FIG. 17 is a cross sectional view taken along the plane 17—17 in FIG. 15.

The externally-channeled hollow extension 32, slidably engageable with the inner surface portion of the cylinder neck 42 and carried by the overcap throat 62, in turn, carries the fluid passageway 30 and provides fluid communication between the fluid passageway 30 and the fluid-mixing region R. At least one external channel 70 (FIGS. 15 and 16) of the hollow extension 32 is able to provide fluid communication between the one cylinder chamber 46A (FIGS. 3, 4 and 7) and the fluid-mixing region R. (See, e.g., FIG. 4.)

Rotation of one of the cylinder 24 and overcap 28 relative to the other about the longitudinal axis X—X causes relative movement as between the externally-channeled hollow extension 32 and the cylinder neck 42 along the longitudinal axis X—X. (Please compare FIGS. 4 and 7.)

The one valve 34, carried by the base 22, is disposed in the coupling 40, as is shown in FIGS. 3 and 6. The second valve 36 (FIG. 8), which abuttingly engages the first valve 34, is carried by that end portion of the fluid passageway 30 which is in distal relation to the extension 32. (See also FIGS. 3 and 6.) The third valve 38 (FIGS. 4 and 7), provided by movement of the external channels 70 of the hollow extension 32 relative to the inner surface of the cylinder neck 42 along the longitudinal axis X—X, controllably affects flow between the one cylinder chamber 46A and the fluid-mixing region R. Relative movement as between the hollow extension 32 and the cylinder neck 42 along the longitudinal axis X—X, in turn, causes the first valve 34 and the second valve 36 to co-act in such a manner as to controllably affect flow of the pressurized fluid from the pressurized-fluid source to the fluid passageway 30 and to the other cylinder chamber 48A (FIG. 3), the fluid passageway 30 thereby providing fluid communication between the pressurized-fluid source and the fluid-mixing region R.

Figure 9:
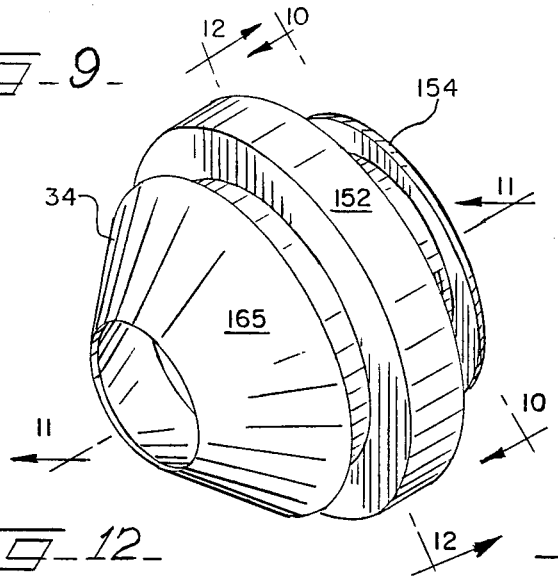
FIG. 9 is a perspective view of another preferred valve element, utilized within the dispensing system of the present invention, on an enlarged scale relative to FIGS. 3 and 6, such valve element being shown in its "open" position.
Figure 13:
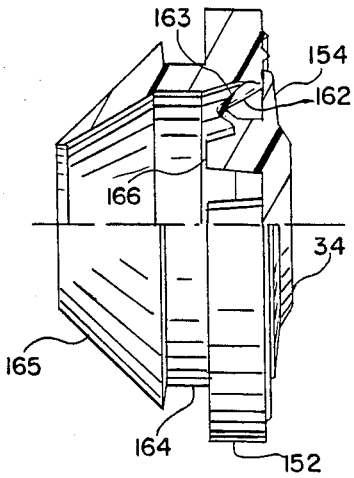
FIG. 13 is an axial or side view (much like the view of FIG. 11), partially longitudinally in section, showing the relative positions of certain valve element component parts, such valve element being shown in its "closed" position.
Figure 10:
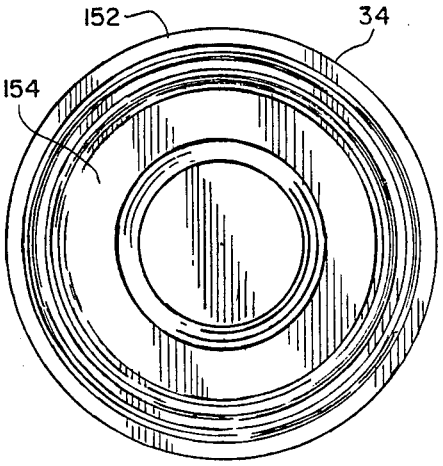
FIG. 10 is a top plan view of the valve element of FIG. 9, taken from the plane 10—10 in FIG. 9.
Figure 14:
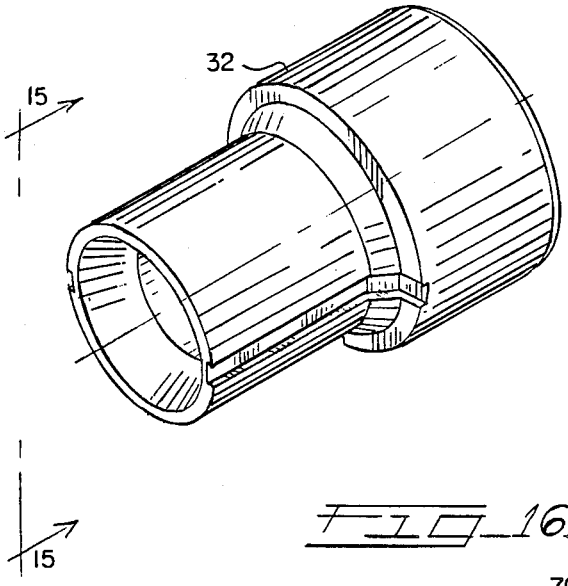
FIG. 14 is a perspective view of yet another internal element of the piston-powered dispensing system of the present invention, on an enlarged scale relative to FIGS. 4 and 7.

The first valve 34, carried by the base 22 (as was briefly mentioned hereinabove), is utilized for controllably affecting flow of the pressurized fluid from the pressurized-fluid source to the fluid passageway 30 and into the second chamber 48A. While the various elements or component parts of the first valve 34 will more particularly be described hereinbelow, the following brief comments can be made at this juncture. The first valve 34 is so dimensioned relative to the threaded coupling 40 (of the base 22) and the threaded end 65 of the conduit 64 as to be removably disposable therebetween. The valve 34, moreover, is preferably so configured as to include an annular so-called "washer" portion 152 (see, e.g., FIGS. 9 and 11) that is urged by threaded end 65 into a recess formed within the threaded coupling 40, for providing a fluid-tight seal between threaded end 65 and coupling 40 when the first valve 34 is in its "closed" position, as is shown in FIGS. 6 and 13. It can be appreciated, moreover, that a suitable fluid flow-check device (not shown) can be incorporated into conduit 64 or located upstream therefrom to prevent siphoning of fluid from the fluid-dispensing system of the present invention back to the pressurized-fluid source, if such is needed or desired.

Figure 8:
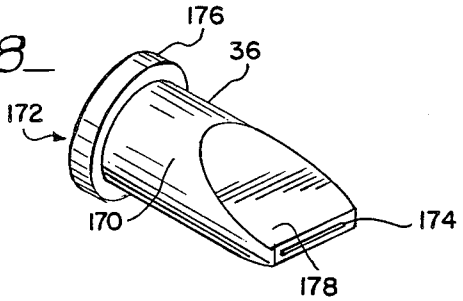
FIG. 8 is a perspective view of one preferred valve elements, utilized within the dispensing system of the present invention, on an enlarged scale relative to FIGS. 3 and 6.

The second valve 36, shown in FIG. 8, is preferably a so-called "duck bill" type valve having a hollow cylindrical portion 170 which is removably and snugly disposable into fluid passageway 30. Valve 36, provided with an inlet 172 and an outlet 174, further includes an annular washer portion 176 which is urged by one end portion of the fluid passageway 30 into abutting engagement with valve 34. (Compare FIGS. 3 and 6.)

The third valve 38, provided by movement in the direction of the longitudinal axis X--X of one of the cylinder neck 42 and externally-channeled extension 32 relative to the other (FIGS. 4 and 7), is utilized to controllably affect fluid flow between the first chamber 46A of the cylinder 24 and the fluid-mixing region R.

it is contemplated, in accordance with the principles of the present invention, that the overcap 28 and hollow cylinder 24 can each be provided with engageable leveraging means, for causing one of the overcap 28 and cylinder 24 to be displaced along the cylinder longitudinal axis X—X relative to the other when either one of the overcap 28 or cylinder 24 is rotated about the longitudinal axis X—X relative to the other. Accordingly, brief reference to FIGS. 1 and 5 is now invited, so that the illustrated embodiment of the engageable leveraging means (for the overcap-and-cylinder combination) can now briefly be discussed.

In such embodiment, which is preferred in certain situations (as will be appreciated from discussion appearing hereinbelow), the overcap 28 (FIGS. 4 and 7) is so formed as to define cam tracks 85 through predetermined sidewall portions of overcap 28, (FIGS. 1 and 5). The illustrated embodiment of the overcap 28, accordingly, preferably defines two such cam tracks 85 (FIG. 6), spaced apart at about 180 degrees from each other. (FIG. 6.) The hollow cylinder 24 of the illustrated embodiment (FIG. 5), in turn, is so formed as to define two circumferentially spaced lobes or protuberances 90, radially-disposed and outwardly extending from the exterior surface of the cylinder 24.

To enable the overcap 28 to be readily rotatable about the longitudinal axis X—X relative to the cylinder 24, the overcap 28 (FIG. 2) and base 22 (FIG. 6) are provided with longitudinally disposed external grooves 104 and 103, respectively.

It will be noted that the overcap 28 further defines a pair of internally-disposed ramps 88 (FIGS. 4 and 7), so dimensioned and so formed within the inner surface of the overcap 28 as to accommodate the lobes or protuberances 90 that are unitary with the cylinder 24.

The overcap 28 is preferably made of a material that is able to flex to a degree such that the lobes 90 of the cylinder 24 are removably insertable into the cam tracks 85 of the overcap 28. The overcap 28 is thus retained on the cylinder 24 by forcing the retaining lobes 90 past the ramps 88 and into the cam tracks 85.

Reference to FIGS. 9 through 13 is now invited for the purpose of briefly discussing valve 34 which is a modified version of a valve disclosed in U.S. Pat. No. 4,583,688 to Crapser (and assigned to S. C. Johnson & Son, Inc., of Racine, Wisconsin), such patent hereby being incorporated by reference.

Valve 34 comprises the above-mentioned annular washer portion 152, a center-button portion 154, a radially-disposed inner-edge portion 156, and an interconnecting portion 158. (Please refer, in particular, to FIG. 11.)

Figure 12:
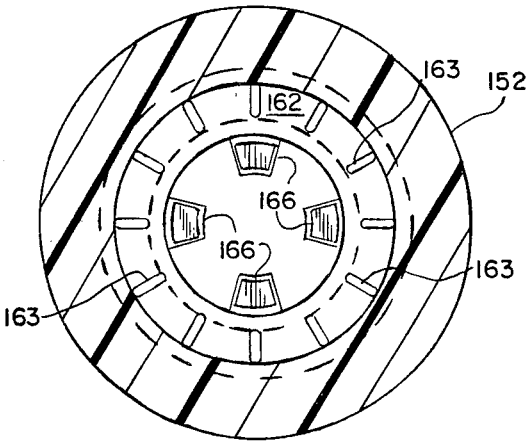
FIG. 12 is a transverse cross sectional view, taken from the planes 12—12 in FIG. 9.
Figure 11:
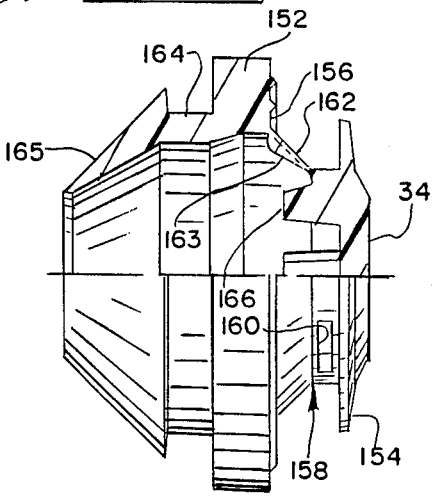
FIG. 11 is an axial or side view, partially longitudinally in section and taken from the planes 11—11 in FIG. 9, showing the relative positions of certain valve element component parts (such valve element being shown in its "open" position)

The annular washer portion 152 is so configured and positioned within the threaded coupling 40 of the base 22 as to be terminally urgeable by threaded end 65 of conduit 64 into the above-mentioned recess formed in threaded coupling 40. (Please refer to FIGS. 3 and 6.) The interconnecting portion 158, which is unitary with both the button portion 154 and the washer portion 152, includes a hollow, cylindrical section (which defines apertures 160) and a frusto-conical flexible webbing section 162. (FIGS. 11 and 12.) Flexible webbing section 162 is provided with strength through the presence of a plurality of internal unitary ribs 163 (FIG. 11). Preferably twelve such ribs 163, approximately equally peripherally spaced along the inner surface of webbing section 162, are thus provided. (FIG. 12.)

Valve 34 is further provided with a circumferential slot 164 (FIGS. 11 and 13) into which a radially inwardly-disposed portion of threaded coupling 40 is removably insertable. (Please refer to FIG. 6.)

Still further, valve 34 is provided with a flexible conical skirt portion 165, which receives and surrounds and is sealingly engageable with an exterior surface portion of that end portion of fluid passageway 30 that carries valve 36. (Please again refer to FIG. 6.) Valve 34 further comprises abutments 166 which are unitary with that cylindrical section of the valve 34 defining the apertures 160 (FIG. 11). Valve 34 preferably includes four such abutments 166, approximately equally spaced (FIG. 12) within such cylindrical section.

When overcap 28 is rotated about the longitudinal axis X—X relative to cylinder 24 for causing valve 38 to move from its "closed" position (FIGS. 6 and 7) to its "open" position (FIGS. 3 and 4), such rotation also causes valves 34 and 36 to move from their "closed" to their "open" positions. That is, such rotation causes valves 34, 36 and 38 to function in unison.

The external diameter of the button portion 154 is greater than the internal diameter of the inner edge portion 156 of washer 152. (FIGS. 11 and 13.) The result is that when button 154 engages washer 152 (FIG. 13), the flow of the pressurized fluid, such as pressurized water W, through valve 34 is thus blocked. (See FIG. 6.) Such engagement between button 154 and washer 152 occurs, it will be noted, when button 154 is in a downstream axial position relative to washer 152. When, however, button 154 is displaced to an upstream position relative to washer 152 (FIG. 3), the pressurized fluid, preferably pressurized water W, is permitted to pass through apertures 160 and thence into valve 36. The presence of the pressurized fluid in valve 36, in turn, causes the duck-bill portions 178 of valve 36 to separate, thereby enabling the pressurized fluid to flow into the fluid passageway 30. Separation of button 154 from washer 152 also enables the pressurized fluid to flow into that annular chamber which is located exterior of the annular washer portion 176 of valve 36 and within valve 34. Such presence of pressurized fluid in such annular chamber causes the conical skirt portion 165 of valve 34 to become spaced from that exterior surface portion of fluid passageway 30 (which it would normally sealingly overlie), enabling the pressurized fluid to flow into chamber 48A. (Please also compare FIGS. 3 and 6.)

Conversely, because valve 34 is so formed as to include—as a unitary element or component—the webbing 162, the presence of such flexible webbing 162 thus enables the annular washer portion 176 of valve 36 (shown in FIG. 6 as abuttingly engaging valve 34) to cause button 154 and inner edge 156 to become spaced apart when the externally-channeled hollow extension 32 is moved to the right relative to hollow neck 42 (as is shown in FIG. 3), thereby causing valve 34 to open. (Please again compare FIGS. 3 and 6.)

Valves 34 and 36 are each thus manufactured, in accordance with the principles of the present invention, from a suitable, resiliently-deformable substance such as natural rubber, synthetic rubber, or another suitable elastomeric polymeric material.

A preferred pressurized-fluid source, for the piston-powered fluid-dispensing system of the present invention, is a pressurized-water source (not shown). With valve 34 in its "closed" position (FIG. 6), pressurized water W exerts force on one side of valve 34. When threaded end 65 of conduit 64 urges valve 34 into engagement with the above-described inner recess of threaded coupling 40, and with valve 34 in its "closed" position, no water is able to pass valve 34 and enter the other elements or components of the fluid-dispensing system 20.

As mentioned above, when the button portion 154 of valve 34 sealingly overlies the annular washer portion 152 (as is shown in FIGS. 6 and 13), the first valve 34 is closed. As FIG. 6 illustrates, the second valve 36 and third valve 38 are both also closed, when the first valve 34 is in its "closed" position.

Initially, the first chamber 46B (see, e.g., FIG. 6) defines a major portion of the total volume of hollow cylinder 24. Such chamber 46B is designed or otherwise adapted to contain a fluid that the user wants to dispense. Such fluid can be a medicinal composition, a disinfectant, a fungicide, a repellent, or another fluid chemical composition such as an insecticide, a fertilizer, and the like. The term "fluid chemical composition" as used throughout this patent specification includes a viscous yet flowable gel. Preferably, the first chamber 46B contains a lawn-and-garden type of fluid chemical composition such as a fertilizer, a herbicide, an insecticide, or the like; and the various elements or components of the fluid-dispensing system 20 (which are in contact therewith) are manufactured from a material or substance that is not corroded, dissolved, or otherwise affected by the fluid chemical composition contained within first chamber 46B.

The manner of removably joining the base 22 to the hollow cylinder 24 is a matter of design choice. That is, the base 22 and cylinder 24 can permanently be joined together such as by being spin-welded together. Such a manner of affixing the base 22 to the cylinder 24 is preferable if the fluid-dispensing system is marketed as a pre-filled one-time-use article. Generally, however, the base 22 and cylinder 24 can removably be joined together in a variety of other ways. For example, in certain situations, it will be desirable for the base 22 and cylinder 24, initially fitted together in a substantially fluid tight manner, to become forced apart when fluid pressure in the second chamber 48B (see, e.g., FIG. 6) becomes greater than a predetermined value. The various components or elements of the fluid dispensing system 20—in particular the sidewalls of cylinder 24—are generally relatively dimensioned and fabricated from a suitable substance or material such that overpressurization of the second chamber 49B (see, e.g., FIG. 6) beyond such a predetermined pressure value, would rarely, if ever, occur.

Still generally referring to FIGS. 3 and 6 (except where noted), operation of the illustrated fluid-dispensing system 20 will now briefly be summarized. In the discussing appearing immediately below, the pressurized fluid is pressurized water.

With the first chamber 46B (FIG. 6) filled with the desired fluid chemical composition (which the user desires to dispense)—and with the three valves 34, 36 and 38 closed—user can, while holding the cylinder 24 with one hand, rotate the overcap 28 (relative to the cylinder 24) which is being held by the other hand about longitudinal axis X—X, thereby causing valve 34 and, thereafter, valve 36 to open. Such rotation of these components or elements of the fluid-dispensing system 20 will cause pressurized water W to pass through fluid passageway 30 and hollow extension 32, and be dispensed from the fluid dispensing system 20 via the orifice 68 (FIG. 2). As the second valve 36 thus is caused to open (FIG. 3), the second chamber 48B (see, e.g., FIG. 6) will also fill with pressurized water W and thus become pressurized. As second chamber 48B becomes pressurized, the fluid pressure in chamber 48B will act upon piston 26, causing piston 26 to move to the left. (Please compare FIGS. 3 and 6.) With the third valve 38 open (as a result of the above-described rotation as between the overcap 28 and cylinder 24 about the longitudinal axis X—X), the pressure in the second chamber 48B thus acts upon the piston 26, thereby causing piston 26 to urge the desired fluid chemical composition out of the first chamber 46B (see, e.g., FIG. 6) and into the mixing region R, via the external channels 70 of extension 32, where mixing as between the chemical composition and pressurized fluid takes place. (See FIG. 4.) Pressurized fluid, introduced into the fluid-mixing region R via the fluid passageway 30 and hollow extension 32, in turn causes such a mixture to be forced out of the fluid-mixing region. As can be appreciated, the shape and dimensions of the nozzle 66 and orifice 68 (FIG. 2) determine the spray pattern of the mixture; and, as mentioned above, such dimensions can readily be altered by those skilled in the art to provide desired spray patterns of the mixture.

Thus, in operation, the volume of the first (or chemical composition-containing) chamber 46A is continuously decreasing while the volume of the second (or pressurized water-containing) chamber 48A is continuously increasing, as a result of the above-described motion of piston 26 within cylinder 24 (please compare FIGS. 3 and 6).

The present invention thus provides the sophisticated consumer with a simple-to-operate fluid-dispensing system which possesses numerous desirable features, as can be appreciated from the above-presented discussion. The present fluid-dispensing system, for example, provides a two-compartmented hollow cylinder, a rotatable cap on one end of the cylinder, and an internal water-supply channel that is disposed through both cylinder compartments. One compartment is adapted to contain a concentrated chemical ingredient. The other compartment is adapted to contain a pressurized fluid, preferably pressurized water. Such water is preferably supplied to the cylinder via a conventional residential garden hose.

It can be appreciated that the water-supply channel can be necked-down to create a back-pressure in the water-supply channel so as to favor flow of water into the pressurizable (e.g. pressurized water-containing) compartment, if desirable. Such a modification would also tend to reduce fluid pressure in the overcap throat, which is desirable (in certain situations), as can further be appreciated.

A slidable piston, separating the chambers, and set in motion by pressure build-up in the pressurizable chamber, forces the concentrated chemical out of the other chamber. Within the fluid-dispensing system, the dilutable concentrated ingredient and the pressurized diluting fluid (i.e. water) flow through separate fluid passageways until they are combined and mixed within an internal-mixing region. Rotation of the overcap (relative to the cylinder) enables the separated fluid ingredients to become internally mixed, thereby enabling the user to dispense the mixture—in the form of a spray or mist—at a desired dispensing area or region. Still further, rotation of the overcap in the opposite direction closes the valves, thereby enabling the user to store the dispensing system for a period of time—for several months, e.g.—if desired.

What has been illustrated and described herein is a novel piston-powered fluid-dispensing system. While the fluid-dispensing system of the present invention has been described with reference to a preferred embodiment, it is to be understood that the present invention is not to be limited thereto. For example, the cylinder can be produced from a transparent or translucent material, if desired; and the cylinder can be so formed as to include a plurality of numbered relative-amount graduations, thereby providing means for visably informing the user of the relative amount of fluid chemical composition present within the cylinder before and after use. Such a feature thus enables a consumer (or other such user) to know generally how much of the fluid chemical composition has been dispensed and how much remains in the cylinder (of the fluid-dispensing system of the present invention) after use.

Accordingly, alternatives, changes and modifications will become apparent to those skilled in the art upon reading the foregoing description. Such alternatives, changes and modifications, moreover, are to be considered as forming a part of the present invention insofar as they fall within the spirit and scope of the appended claims.

We Claim:

1. A piston-powered dispensing system comprising:

an apertured base;

a hollow, elongated cylinder defining a longitudinal axis and carrying the base at one end portion thereof and further defining a hollow neck at the opposite end portion thereof:

an apertured piston disposed in the cylinder for dividing the cylinder into at least two chambers and defining a circumferential portion that is slidably engageable with the hollow cylinder substantially along the length of an inner surface thereof;

a hollow, orificed overcap, carried by the cylinder and rotatable about the longitudinal axis relative thereto, defining an internal, fluid-mixing region and a throat that is in fluid communication with said region, the throat being slidably engageable with an inner surface portion of the cylinder neck;

an elongated fluid passageway means disposed through the piston aperture in a fluid-tight manner;

an externally-channeled, hollow extension slidably engageable with the inner surface portion of the cylinder neck and carried by the overcap throat, the hollow extension carrying the fluid passageway means and providing fluid communication between the fluid passageway means and the fluid-mixing region, at least one external channel of the hollow extension being selectively able to provide fluid communication between one of the two cylinder chambers and the fluid-mixing region, whereby rotation of one of the cylinder and overcap relative to the other about the longitudinal axis causes relative movement as between the cylinder neck and both of the hollow extension and the overcap throat along the longitudinal axis;

first valve means carried by the base for controllably affecting flow of a pressurized fluid from a pressurized-fluid source to the fluid passageway means and into the other one of the two cylinder chambers:

second valve means carried by the fluid passageway means and abuttingly engaging the first valve means for controllably affecting flow of the pressurized fluid through the fluid passageway means; and third valve means, provided by the relative movement as between the cylinder neck and both of the hollow extension and overcap throat along the longitudinal axis, for controllably affecting flow between said one of the two cylinder chambers and the fluid-mixing region, whereby said relative movement as between the cylinder neck and both of the hollow extension and overcap throat along the longitudinal axis simultaneously causes the first and second valve means to co-act in such a manner as to controllably affect flow of the pressurized fluid from the pressurized-fluid source to the fluid passageway means and to the other one of the two cylinder chambers, the fluid passageway means thereby providing fluid communication between the pressurized-fluid source and the fluid-mixing region.

2. The system of claim 1 wherein the elongated fluid passageway means carries the hollow extension at one end portion thereof, and wherein the second valve means is a duck-bill valve defining a flexible duck-bill portion that is disposed in the opposite end portion of the elongated fluid passage means, the duck-bill valve further defining an annular washer portion which is urged by an end portion of the fluid passageway means into abutting engagement with the first valve means.

3. The system of claim 1 wherein one end portion of the elongated fluid passageway means carries the second valve means, and wherein the first valve means defines a flexible conical skirt portion that externally, circumferentially and sealingly overlies the end portion of the fluid passageway means carrying the second valve means.

4. A piston-powered dispensing system comprising:

an apertured base;

a hollow cylinder defining a longitudinal axis, the cylinder carrying the base at one end portion thereof and further defining a hollow neck at the opposite end portion thereof;

an apertured piston defining a circumferential portion that is slidably engageable with the hollow cylinder substantially along the length of an inner surface thereof and disposed in the cylinder for dividing the cylinder into at least two chambers;

an orificed overcap carried by the cylinder and rotatable about the longitudinal axis relative thereto, the overcap defining a fluid-mixing region and a throat that is slidably engageable with an inner surface portion of the cylinder neck;

an elongated fluid passageway means carried by the overcap and disposed through the piston aperture in a fluid-tight manner;

a hollow extension, slidably engageable with the inner surface portion of the cylinder neck and carried by the overcap throat, whereby rotation of one of the overcap and cylinder relative to the other about the longitudinal axis thus causes movement along the longitudinal axis of the cylinder neck relative to both of the extension and overcap throat;

first valve means carried by the base for controllably affecting flow of a pressurized fluid from a pressurized-fluid source into the fluid passageway means and into one of the two cylinder chambers;

second valve means carried by the fluid passageway means and abuttingly engaging the first valve means for controllably affecting flow of the pressurized fluid through the fluid passageway means; and third valve means provided by said movement along the longitudinal axis of the cylinder neck relative to both of the extension and overcap throat, for controllably affecting flow between an other one of the two cylinder chambers and the fluid-mixing region, whereby said movement of said one of the overcap throat and cylinder neck relative to said other along the longitudinal axis simultaneously causes the first and second valve means to co-act in such a manner as to controllably affect flow of the pressurized fluid from the pressurized-fluid source into and through the fluid passageway means and into said one of the two cylinder chambers.

* * * * *